US009060626B2

(12) United States Patent
Berg

(10) Patent No.: US 9,060,626 B2
(45) Date of Patent: Jun. 23, 2015

(54) ANTI-WRINKLE PILLOW

(71) Applicant: Bicor Processing Corp., Brooklyn, NY (US)

(72) Inventor: Allan Berg, Atlantic Beach, NY (US)

(73) Assignee: Bicor Processing Corp., Brooklyn, NY (US)

( * ) Notice: Subject to any disclaimer, the term of this patent is extended or adjusted under 35 U.S.C. 154(b) by 0 days.

(21) Appl. No.: 13/927,499

(22) Filed: Jun. 26, 2013

(65) Prior Publication Data

US 2014/0000035 A1 Jan. 2, 2014

Related U.S. Application Data

(60) Provisional application No. 61/665,640, filed on Jun. 28, 2012.

(51) Int. Cl.
*A47G 9/10* (2006.01)

(52) U.S. Cl.
CPC ..... *A47G 9/10* (2013.01); *Y10T 29/49826* (2015.01); *A47G 9/1081* (2013.01); *A47G 9/109* (2013.01)

(58) Field of Classification Search
CPC .... A47C 27/002; A47C 27/003; A47C 27/12; A47C 27/125; A47C 27/22; A47C 31/026; A47G 9/10; A47G 9/1081; A47G 9/109; A47G 9/1054; A47G 9/1072
USPC ..... 5/630, 636, 637, 645, 696, 731, 736, 5/652, 653, 655.6, 901; D6/601
See application file for complete search history.

(56) References Cited

U.S. PATENT DOCUMENTS

| | | | | | |
|---|---|---|---|---|---|
| D27,158 | S | * | 6/1897 | Burns | D6/502 |
| 1,356,320 | A | * | 10/1920 | Solomon | 5/655.6 |
| 1,666,280 | A | * | 4/1928 | Brandwein | 5/696 |
| 4,563,785 | A | * | 1/1986 | Samelson | 428/102 |
| 4,903,357 | A | * | 2/1990 | Kruchen et al. | 5/636 |
| 5,363,524 | A | * | 11/1994 | Lang | 5/640 |
| 5,429,852 | A | * | 7/1995 | Quinn | 428/71 |
| 2006/0016011 | A1 | * | 1/2006 | Berg | 5/636 |

FOREIGN PATENT DOCUMENTS

| | | | |
|---|---|---|---|
| DE | 3428993 | A1 * | 2/1986 |
| DE | 9015608 | U1 * | 3/1990 |

* cited by examiner

*Primary Examiner* — Nicholas Polito
(74) *Attorney, Agent, or Firm* — Hoffmann & Baron, LLP

(57) ABSTRACT

An anti-wrinkle pillow including a pillow casing, first recess and second recess. The pillow casing has a bottom and top and is filled with fill material. The first recess is formed by securing the bottom to the top and is disposed at a first location. The second recess is formed by securing the bottom to the top and disposed at a second location. The second location is predetermined distance from the first location, such that the first recess and the second recess define first and second raised portions delineated by a trough portion. The first and second raised portions are configured to contact first and second portions of a user's face. The trough portion and the second recess are configured to remain contactless with the one or more portions of the user's face to mitigate wrinkling of the one or more portions of the user's face along the predetermined distance.

18 Claims, 7 Drawing Sheets

ANTI-WRINKLE PILLOW

CROSS REFERENCE TO RELATED APPLICATION

This application claims priority to and benefit of U.S. Provisional Patent Application No. 61/665,640 filed on Jun. 28, 2012, the disclosure of which is incorporated in its entirety by reference herein.

BACKGROUND

1. Field

The present application relates to pillows. More specifically, the present application is directed to an anti-wrinkle pillow and a method of manufacturing an anti-wrinkle pillow.

2. Brief Discussion of Related Art

Invariably, rest and sleep are among the body's numerous mechanisms to heal itself from the postural, physical and nervous assaults throughout the previous day. Conventional pillows, which include a pillow casing filled with fill material, are known in the art and they have not undergone significant changes in the many years of pillow making.

In recent years, various specialty pillows, generally made of memory material (e.g., memory foam) have been designed to provide upper back, neck and head support in order to keep the upper spine and neck in neural positions. Other specialty pillows have been designed to reduce wrinkling of the face, which can be exacerbated when certain portions of the face prone to wrinkling contact and press on the surface of the pillow during sleep.

Yet, the foregoing specialty pillows are expensive to manufacture. It would be desirable to make available a conventional pillow that can provide supported and anti-wrinkle sleeping positions for the user, while reducing pillow production costs associated with specialty pillows.

SUMMARY

In accordance with an embodiment, an anti-wrinkle pillow is disclosed. The pillow includes a pillow casing, a first recess and a second recess. The pillow casing has a bottom sheet and a top sheet. The pillow casing is further filled with a fill material. The first recess is formed by securing the bottom sheet to the top sheet. The first recess is disposed at a first location of the pillow casing. The second recess is formed by securing the bottom sheet to the top sheet. The second recess is disposed at a second location of the pillow casing.

The second location is a predetermined distance from the first location, such that the first recess and the second recess define a first and second raised portions delineated by a trough portion along the predetermined distance. The first and the second raised portions are configured to contact first and second portions of a user's face. The trough portion and the second recess are configured to remain contactless with the one or more portions of the user's face to mitigate wrinkling of the one or more portions of the user's face along the predetermined distance.

In accordance with another embodiment, a method of manufacturing an anti-wrinkle pillow is disclosed. According to the method, a pillow that includes a pillow casing and a fill material is provided. The pillow casing has a bottom sheet and a top sheet and is filled with the fill material. The bottom sheet is secured to the top sheet at a first location of the pillow casing to form a first recess. The bottom sheet is further secured to the top sheet at a second location of the pillow casing to form a second recess The second location is at a predetermined distance from the first location, such that the first recess and the second recess define first and second raised portions delineated by a trough portion along the predetermined distance. The first and the second raised portions are configured to contact first and second portions of a user's face. The trough portion and the second recess are configured to remain contactless with the one or more portions of the user's face to mitigate wrinkling of the one or more portions of the user's face along the predetermined distance.

These and other purposes, goals and advantages of the present application will become apparent from the following detailed description of example embodiments read in connection with the accompanying drawings.

BRIEF DESCRIPTION OF THE DRAWINGS

Some embodiments are illustrated by way of example and not limitation in the figures of the accompanying drawings in which.

DETAILED DESCRIPTION

An anti-wrinkle pillow and a method of manufacturing an anti-wrinkle pillow are disclosed herein. In the following description, for the purposes of explanation, numerous specific details are set forth in order to provide a thorough understanding of example embodiments. It will be evident, however, to one skilled in the art, that an example embodiment may be practiced without all of the disclosed specific details.

Figure 1:
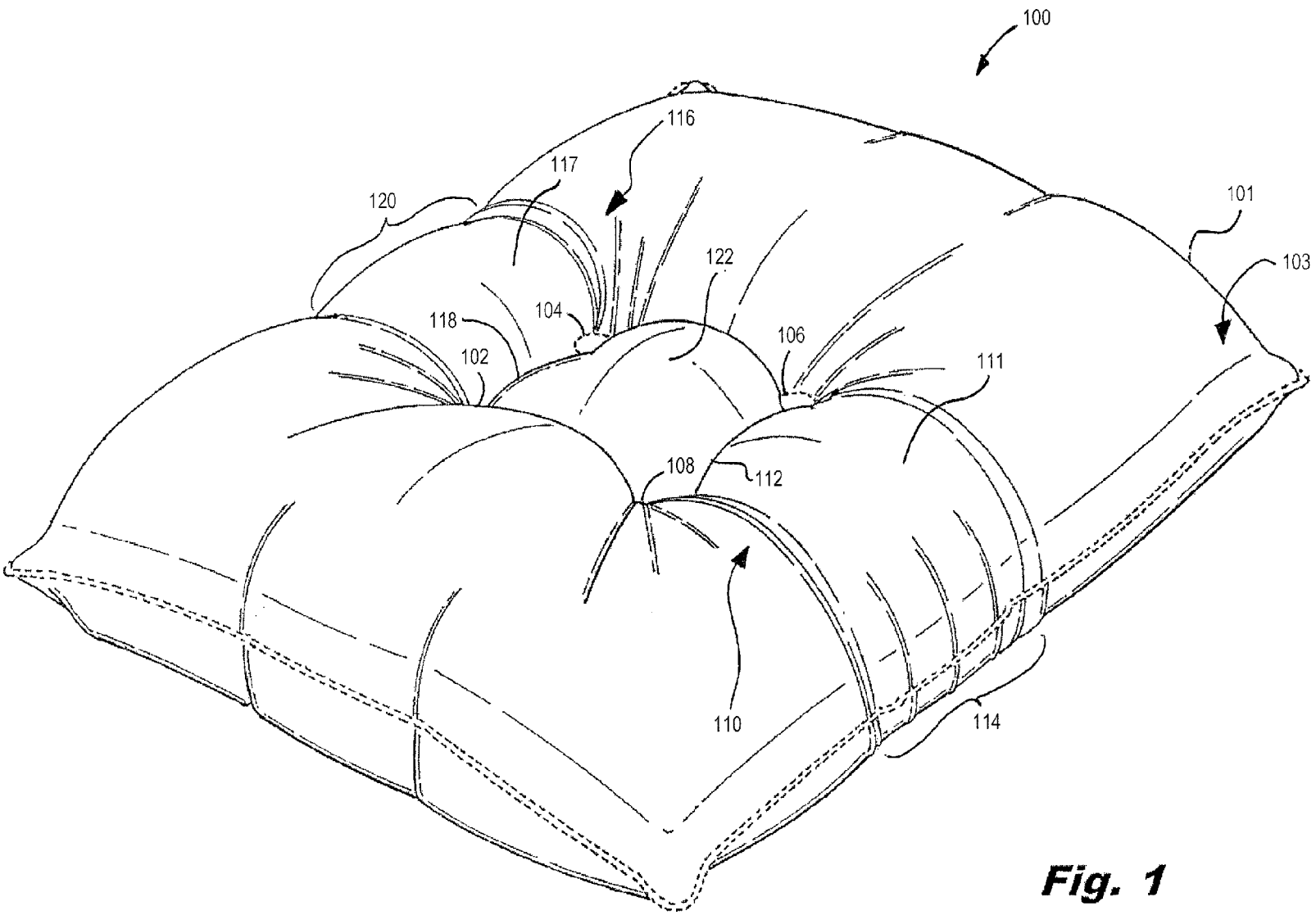
FIG. 1 illustrates a perspective view of an example anti-wrinkle pillow in accordance with a first embodiment.

FIG. 1 illustrates a perspective view of an example anti-wrinkle pillow 100 in accordance with a first embodiment. The pillow 100 includes a pillow casing 101, fill material 103, depressions (or recesses) 102-108.

The pillow 100 has dimensions including a length and a width, such as 15 inches by 22 inches or 20 inches by 26 inches. However, the pillow 100 can be of any conventional dimensions, or otherwise any desirable dimensions.

The pillow casing 101 is configured (e.g., sized and dimensioned) to receive the fill material 103 as described below. The pillow casing 101 can be made of cotton, a combination of cotton and another material (e.g., polyester-cotton combination), or any other conventional material or combination of materials (e.g., silk, satin and/or other materials).

The fill material 103 can be a slick fiberfill (e.g., silicon-coated material), or a dry fiberfill (e.g., a garneted material). Other fill materials can be used. The fill material 103 can be blown in or formed in a sheet having a length and width, which can be folded one or more times into a configuration (e.g., having width, length, height) that can be inserted into the pillow casing 101. The amount of fill material 103 in the sheet can be varied to provide various degrees of softness/firmness to the pillow 100. Although other fill materials are not described herein for brevity and clarity, they are nonetheless considered to be within the scope of the present application.

The recesses 102-108 can be formed by compressing fill material 103 in the pillow 100 and securing the top surface to the bottom surface of the pillow casing 101 via stitching or in another manner at a predetermined distance from one another (e.g., 1 inch between surfaces of the pillow casing 101). The innermost shape of the recesses 102-108 can be generally circular, of another shape, or a combination of shapes. In one embodiment, the recesses are circular having a diameter of about 1 inch. Other diameters are of course possible.

An advantage associated circular shape is that the recesses 102-108 can have approximately conically or outwardly sloped wall portions, which can approximate the size of the head of a user and can effectively cradle a portion of the user's head during operation or use of the pillow 100. That is, the person's head can be cradled in any depression 102-108 and supported by the outwardly sloping wall portions.

Moreover, the positioning of the recesses 102-108 defines an approximately square shape at about the center of the pillow 100, although other shapes (e.g., rectangular) can also be defined. The distance between centers of the recesses can extend along the horizontal plane of the pillow 100 from between about 5 inches to about 6 inches, as will be described hereinbelow in greater detail. Other distances can be used depending on the population or persons (e.g., kids, adults, etc.) that will use the pillow.

The recesses 102-108 further define respective contoured sleeping areas 110, 116, which can provide comfortable, restful and therapeutic sleeping positions as well as to mitigate wrinkles by preventing one or more portions of a person's face (e.g., cheek, mouth, nose) from contacting the pillow 100 during use of the pillow 100, as will be described in greater detail hereinbelow with reference to FIG. 7.

The contoured sleeping area 110 includes raised portions 111, 122, trough portion 112, and abutment portion 114. The raised portions 111, 122 allow certain portions of the person's head to contact the pillow 100, while the trough 112 prevents other portions of the person's head from contacting the pillow 100. For example, the person's right ear can be disposed in the recess 106, the neck and the upper temple would contact the respective raised portions 111, 122, while one or more portions of the person's head from the ear to the mouth would be disposed over the trough 112 and recess 108, thus being prevented from contacting the pillow 100. The abutment portion 114 allows easy identification and positioning of the person's shoulder area to abut the abutment area 114, such that the right ear can be received into recess 106. In similar fashion, the person's left ear can be disposed in the recess 108, the neck and the upper temple would contact the respective raised portions 111, 122, while one or more portions of the person's head from the ear to the mouth would be disposed over the trough 112 and recess 106, thus being prevented from contacting the pillow 100.

Similarly, the contoured sleeping area 116 includes raised portions 117, 122, trough portion 118, and abutment portion 120. The raised portions 117, 122 allow certain portions of the person's head to contact the pillow 100, while the trough 118 prevents other portions of the person's head from contacting the pillow 100. For example, the person's right ear can be disposed in the recess 102, the neck and the upper temple would contact the respective raised portions 117, 122, while one or more portions of the person's head from the ear to the mouth would be disposed over the trough 118 and recess 104, thus being prevented from contacting the pillow 100. The abutment portion 120 allows easy identification and positioning of the person's shoulder area to abut the abutment area 120, such that the right ear can be received into recess 102. Similarly, the person's left ear can be disposed in the recess 104, the neck and the upper temple would contact the respective raised portions 117, 122, while one or more portions of the person's head from the ear to the mouth would be disposed over the trough 118 and recess 102, thus being prevented from contacting the pillow 100.

The foregoing contoured sleeping areas 110, 116 mitigate or reduce folding or wrinkling of the person's skin that can occur during sleep in the portions of the head/face that are contactless in relation to the pillow, in contrast to the conventional or other pillows in which these portions contact the pillow.

Figure 2:
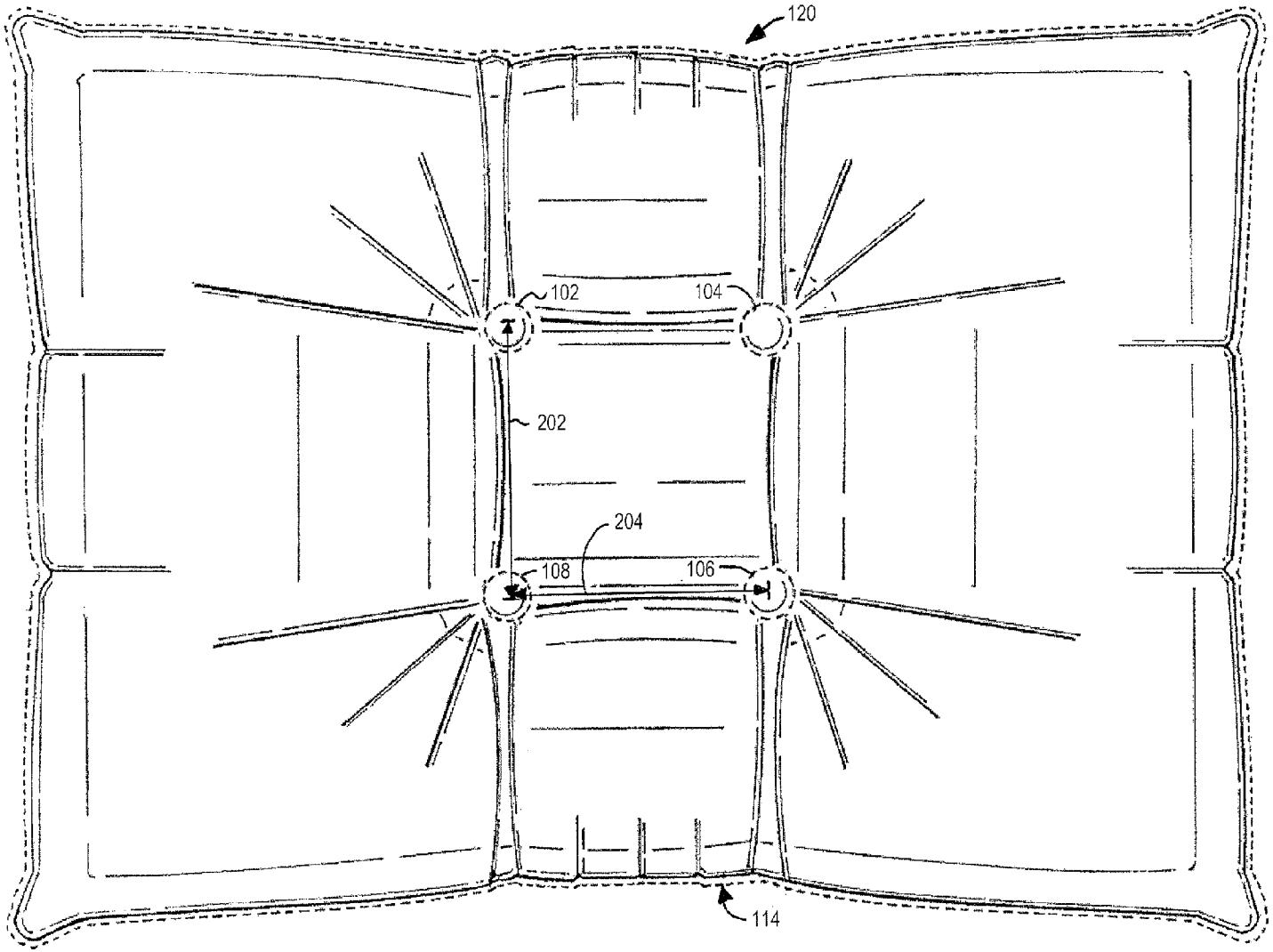
FIG. 2 illustrates a top view of the pillow of FIG. 1 to show the configuration of the recesses.

FIG. 2 illustrates a top view of the pillow 100 of FIG. 1 to show the configuration of the recesses 102-108. More specifically, the recesses 102-108 can be centrally positioned about the pillow 100 and can define a shape. For example, recesses 102-108 define an approximately square shape at about the center of the pillow 100. The distance 202, 204 between the centers of recesses (102, 104), (106, 108), (102, 108) and (104, 106) can be about 5 inches to about 6 inches, forming an approximately square shape at about the center of the pillow.

In different combinations the foregoing distances can be varied. For example, the distance between recesses 102, 104 can be five inches, while the distance between 106, 108 can be six inches, accommodating different lengths between the ear and mouth. As another example, the distance between 102, 108 can be five inches, while the distance between 104, 106 can be six inches. Moreover, individual one or more recesses can be disposed closer or farther from the respective abutment portions 114, 120 to accommodate different neck lengths and alignment of the neck in relation to the pillow 100.

The recesses 102-108 and distance relationship among them and in relationship to the abutment areas 114, 120 can be varied depending on the persons to use the pillow 100.

Figure 3:
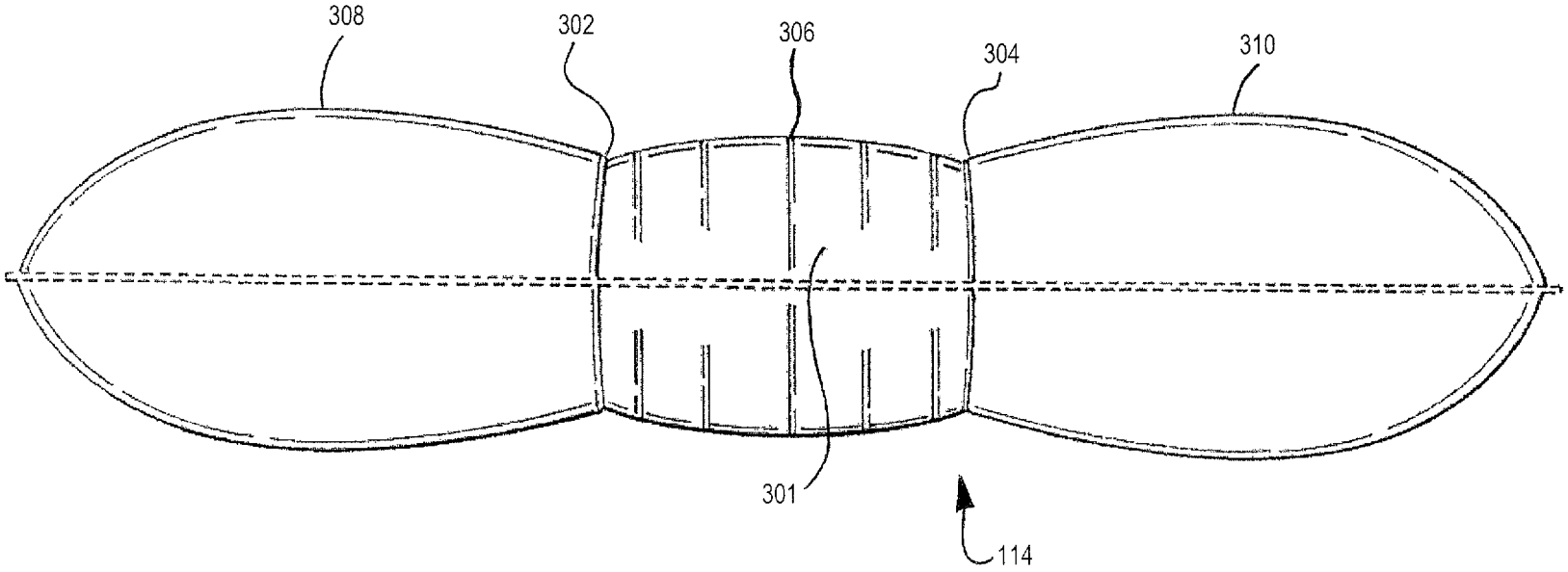
FIG. 3 illustrates a side view of the pillow of FIG. 1 to show the shoulder abutment portions.

FIG. 3 illustrates a side view of the pillow 100 to show the shoulder abutment portions 114. The abutment portion 114 is defined by the recess 102-108 shown in FIG. 1 to include depressions 302, 304 and raised portions 306, 308, 310.

The shoulder area of the person abuts edge contour or surface 301, while neck of the person can be positioned anywhere along portion 306, or depressions 302, 304. Other portions 308, 310 can also be used. The contours can be varied based on positioning of the recesses 102-108 in relation to the pillow 100.

The abutment portion 120 on the other side of the pillow 100 can be defined similarly or differently based on the positioning of the recesses 102-108.

Figure 4:
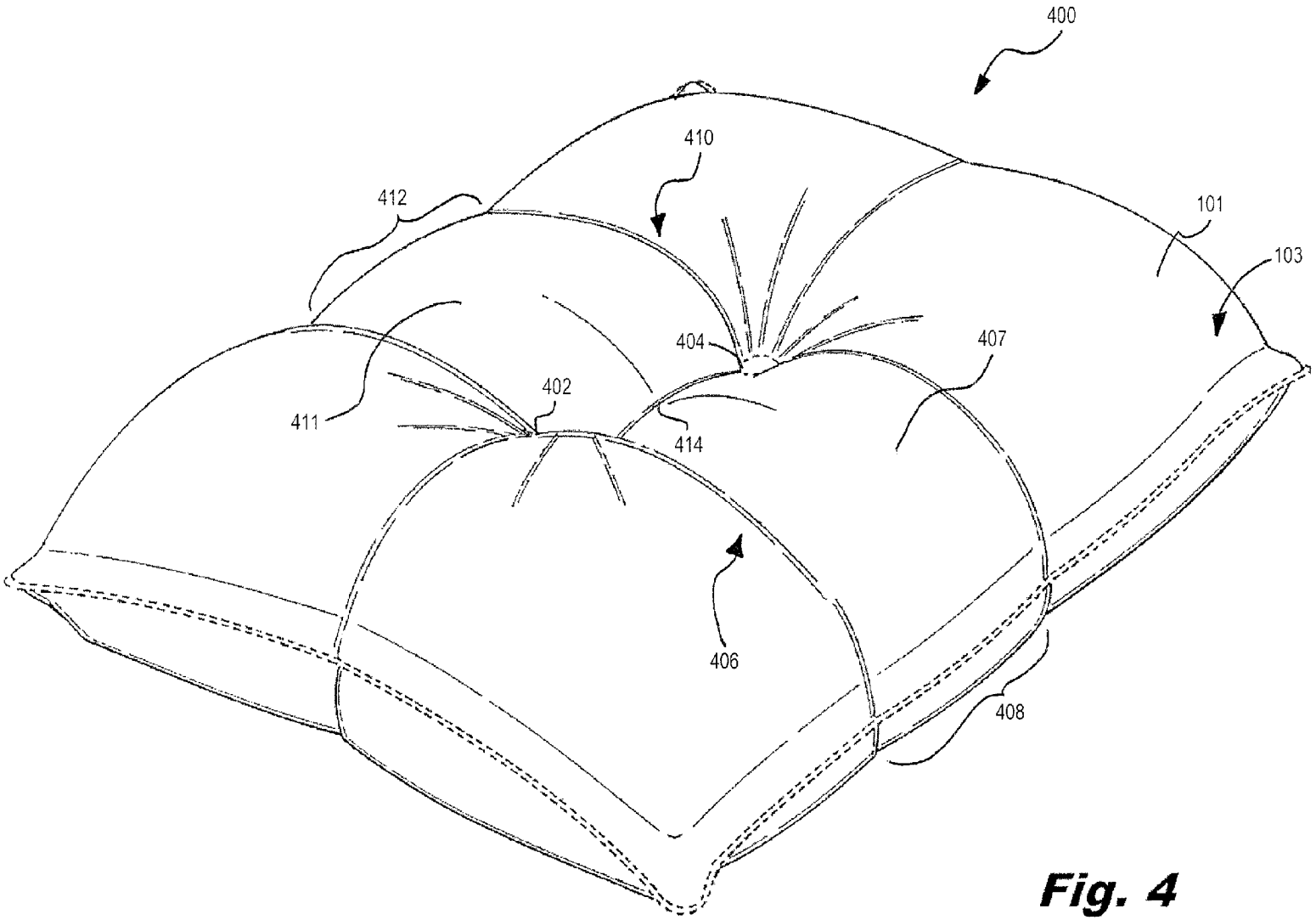
FIG. 4 illustrates a perspective view of an example anti-wrinkle pillow in accordance with a second embodiment.

FIG. 4 illustrates a perspective view of an example anti-wrinkle pillow 100 in accordance with a second embodiment. The pillow 400 includes a pillow casing 101, fill material 103, depressions (or recesses) 402, 404.

The dimensions of the pillow 400 can be similar to or different than the dimension described with reference to pillow 1 of FIG. 1, e.g., 15 inches by 22 inches or 20 inches by 26 inches. However, the pillow 400 can be of any conventional dimensions, or otherwise any desirable dimensions. The pillow casing 101 and fill material 103 can be similar to or different than described with reference to FIG. 1. For example, the pillow casing 101 can cotton, a combination of cotton and another material (e.g., polyester-cotton combination), or any other conventional material or combination of materials (e.g., silk, satin and/or other materials). The fill material 103 can be dry fiberfill, (e.g., a garneted material) and can be blown in or formed in a sheet having a length and width, which can be folded one or more times into a configuration that can be inserted into the pillow casing 101. The amount of fill material 103 in the sheet can be varied to provide various degrees of softness/firmness to the pillow 400. Other fill materials can be used.

The recesses 402, 404 can be formed by compressing fill material 103 in the pillow 400 and securing the top surface to the bottom surface of the pillow casing 101 via stitching or in another manner at a predetermined distance from one another (e.g., 1 inch between surfaces of the pillow casing 101). The innermost shape of the recesses 402, 404 can be generally circular, of another shape, or a combination of shapes. In one embodiment, the recesses are circular having a diameter of about 1 inch. Other diameters are of course possible.

The positioning of the recesses 402, 404 define an approximately linear shape at about the center of the pillow 400. The distance between centers of the recesses can extend along the horizontal plane of the pillow 400 from between about 5 inches to about 6 inches, as will be described hereinbelow in greater detail. Other distances can be used depending on the population or persons (e.g., kids, adults, etc.) that will use the pillow 400.

The recesses 402, 404 further define respective contoured sleeping areas 406, 410, which can provide comfortable, restful and therapeutic sleeping positions as well as to mitigate wrinkles by preventing one or more portions of a person's face (e.g., cheek, mouth, nose) from contacting the pillow 400 during use of the pillow 400, as will be described in greater detail hereinbelow with reference to FIG. 8.

The contoured sleeping area 406 includes raised portions 407, 411, trough portion 414, and abutment portion 408. The raised portions 407, 411 allow certain portions of the person's head to contact the pillow 400, while the trough 414 prevents other portions of the person's head from contacting the pillow 400. For example, the person's right ear can be disposed in the recess 404, the neck and the upper temple would contact the respective raised portions 407, 411, while one or more portions of the person's head from the ear to the mouth would be disposed over the trough 414 and recess 402, thus being prevented from contacting the pillow 400. The abutment portion 408 allows easy identification and positioning of the person's shoulder area to abut the abutment area 408, such that the right ear can be received into recess 404. In similar fashion, the person's left ear can be disposed in the recess 402, the neck and the upper temple would contact the respective raised portions 407, 411, while one or more portions of the person's head from the ear to the mouth would be disposed over the trough 414 and recess 404, thus being prevented from contacting the pillow 400.

Similarly, the contoured sleeping area 410 includes raised portions 411, 407, trough portion 414, and abutment portion 412. The raised portions 411, 407 allow certain portions of the person's head to contact the pillow 400, while the trough 414 prevents other portions of the person's head from contacting the pillow 400. For example, the person's right ear can be disposed in the recess 402, the neck and the upper temple would contact the respective raised portions 411, 407, while one or more portions of the person's head from the ear to the mouth would be disposed over the trough 414 and recess 404, thus being prevented from contacting the pillow 400. The abutment portion 412 allows easy identification and positioning of the person's shoulder area to abut the abutment area 412, such that the right ear can be received into recess 402. Similarly, the person's left ear can be disposed in the recess 404, the neck and the upper temple would contact the respective raised portions 411, 407, while one or more portions of the person's head from the ear to the mouth would be disposed over the trough 414 and recess 402, thus being prevented from contacting the pillow 400.

The foregoing contoured sleeping areas 406, 410 mitigate or reduce folding or wrinkling of the person's skin that can occur during sleep in the portions of the head/face that are contactless in relation to the pillow, in contrast to the conventional or other pillows in which these portions contact the pillow.

Figure 5:
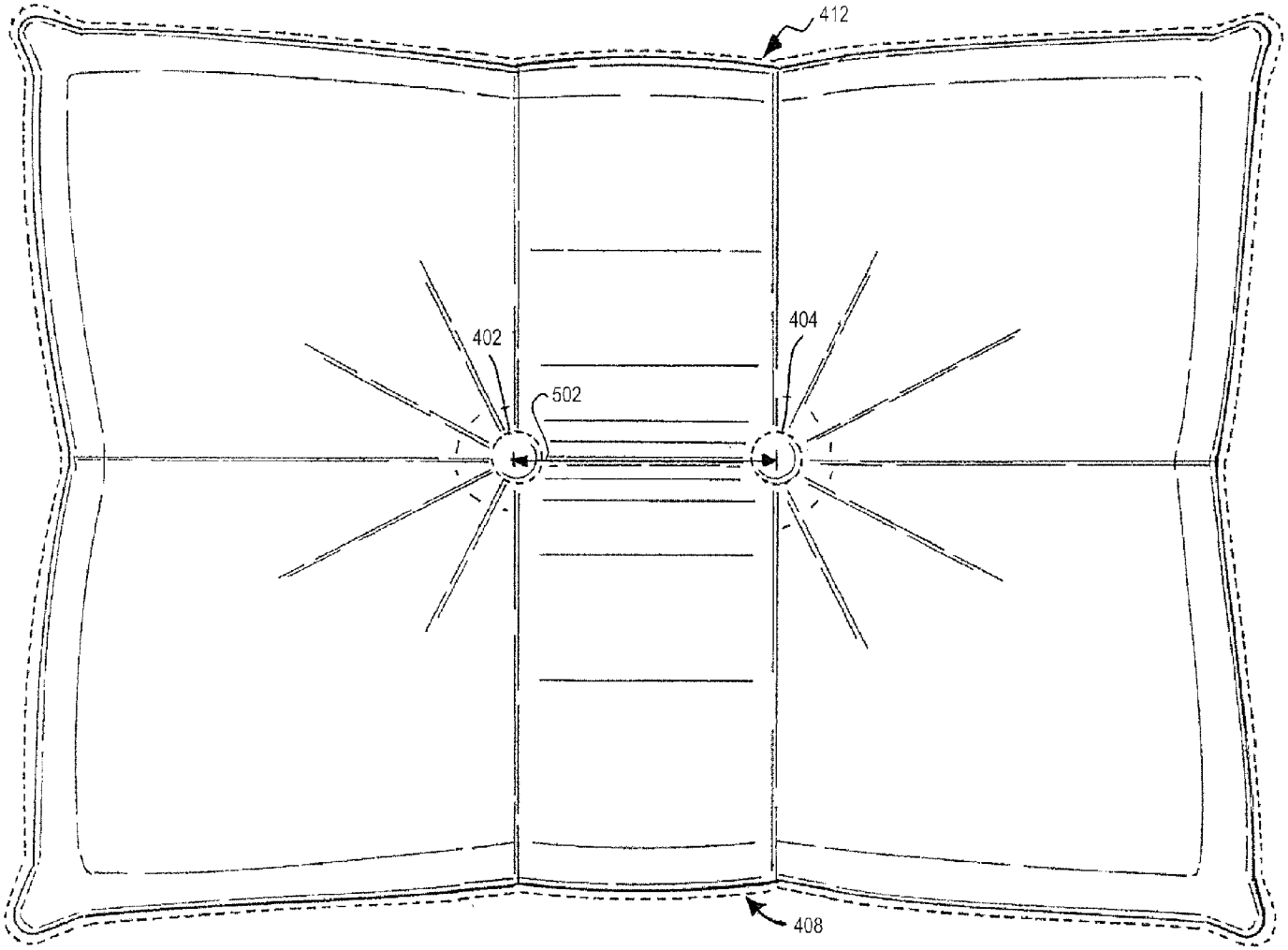
FIG. 5 illustrates a top view of the pillow of FIG. 4 to show the configuration of the recesses.

FIG. 5 illustrates a top view of the pillow 400 of FIG. 4 to show the configuration of the recesses 402, 404. More specifically, the recesses 402, 404 can be centrally positioned about the pillow 400. The distance 502 between the centers of recesses 402, 404 can be about 5 inches to about 6 inches.

In different combinations the foregoing distances between recesses 402, 404 can be varied. Moreover the distance of the recesses 402, 404 to the respective abutment portions 408, 412 can be varied, e.g., both recesses 402, 404 can be closer to one of the abutment portions 408, 412 that the other. Further yet, the distance of one recess in relationship to the abutment areas 408, 412 can also be varied depending on the persons to use the pillow 100. For example, one recess 402 can be closer to one abutment portion 408, while the other recess 404 is closer to abutment portion 412. Other alternatives are also possible.

Figure 6:
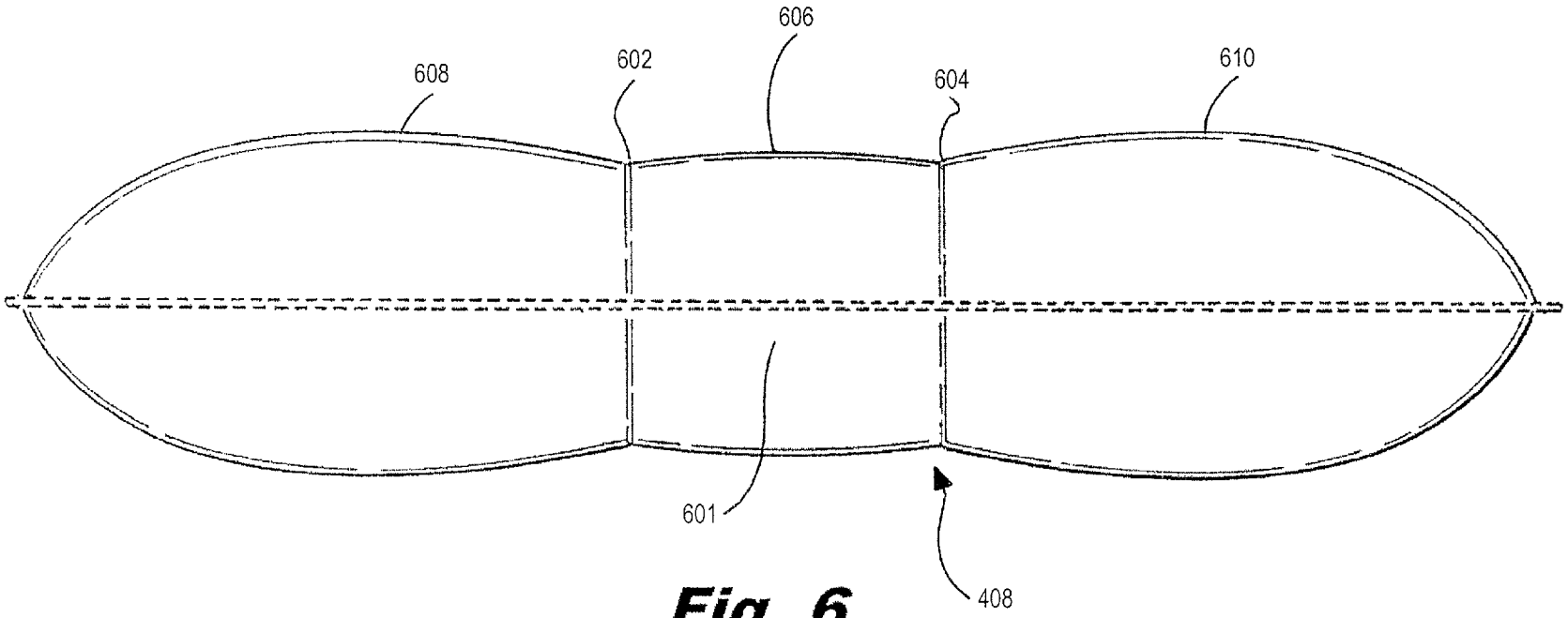
FIG. 6 illustrates a side view of the pillow of FIG. 4 to show the shoulder abutment portions.

FIG. 6 illustrates a side view of the pillow 400 to show the shoulder abutment portions 408. The abutment portion 408 is defined by the recess 402, 404 shown in FIG. 4 to include depressions 602, 604 and raised portions 606, 608, 610.

The shoulder area of the person abuts edge contour or surface 601, while neck of the person can be positioned anywhere along portion 606, or depressions 602, 604. Other portions 608, 610 can also be used. The contours can be varied based on positioning of the recesses 402, 404 in relation to the pillow 400.

The abutment portion 412 on the other side of the pillow 400 can be defined similarly or differently based on the positioning of the recesses 402, 404.

Figure 7:
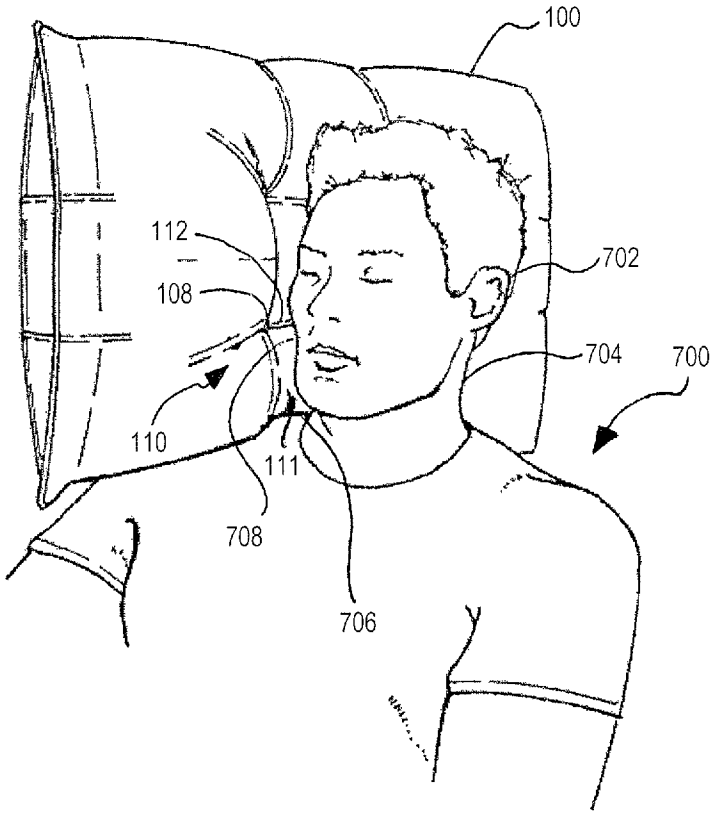
FIG. 7 illustrates an example use of the anti-wrinkle pillow constructed in accordance with the first embodiment in FIGS. 1-3.

FIG. 7 illustrates an example use of the pillow 100 that is constructed in accordance with the first embodiment in FIGS. 1-3. As shown in operation of FIG. 7, a user 700 can use the pillow 100 by sleeping on the user's side in relation to the contoured sleeping area 110 of the pillow 100. More specifically, one of the user's ears 702 can be disposed in the recess 106, as shown in FIG. 1. The user's neck 704 can be disposed about raised portion 111. One or more portions of the user's face (e.g., cheek, mouth, nose) 708 can be over trough 112 and recess 108, and thus be contactless in relation to the pillow 100 to mitigate wrinkles. The user's shoulder 706 can abut the abutment portion 114, as shown in FIG. 1, to provide proper positioning of the user 700 in relation to the pillow 100.

Figure 8:
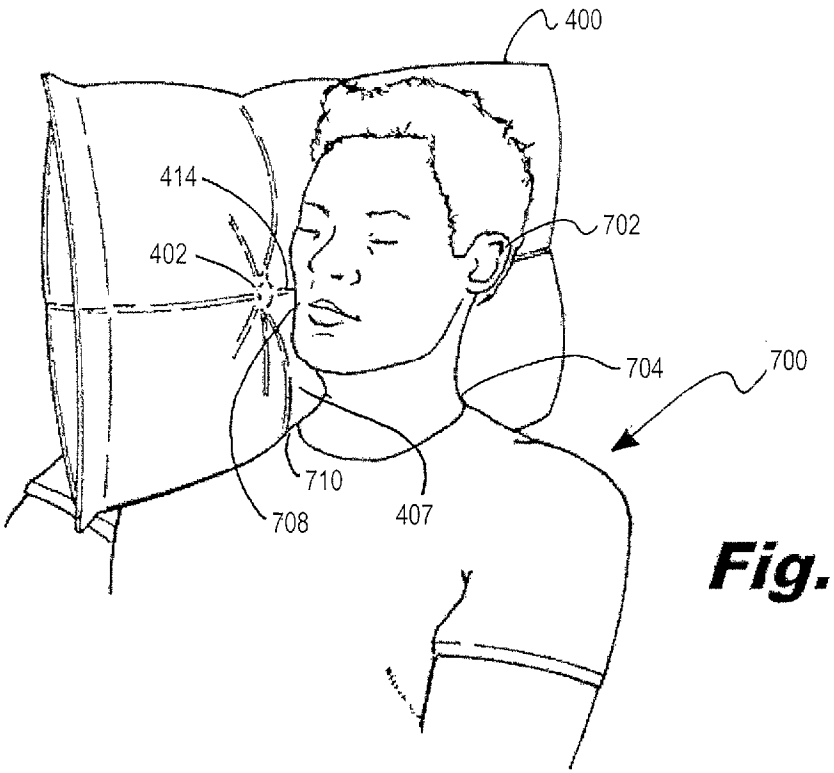
FIG. 8 illustrates an example use of the anti-wrinkle pillow constructed in accordance with the second embodiment in FIGS. 4-6.

FIG. 8 illustrates an example use of the pillow 400 that is constructed in accordance with the second embodiment in FIGS. 4-6. As shown in operation of FIG. 8, a user 700 can use the pillow 400 by sleeping on the user's side in relation to contoured area 406 of the pillow 400. More specifically, one of the user's ears 702 can be disposed in the recess 404, as shown in FIG. 4. The user's neck 704 can be disposed about the raised portion 407. One or more portions of the user's face (e.g., cheek, mouth, nose) 708 can be over trough 414 and recess 402, and thus be contactless in relation to the pillow 100 to mitigate wrinkles. The user's shoulder 706 can abut the abutment portion 408, as shown in FIG. 4, to provide proper positioning of the user 700 in relation to the pillow 400.

Thus, an anti-wrinkle pillow and a method of manufacturing an anti-wrinkle pillow have been described. Although specific example embodiments have been described, it will be evident that various modifications and changes may be made to these embodiments without departing from the broader spirit and scope of the invention.

Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments shown are described in sufficient detail to enable those skilled in the art to practice the teachings disclosed herein. Other embodiments may be utilized and derived therefrom, such that structural and logical substitutions and changes may be made without departing from the scope of this application.

The foregoing detailed description, therefore, is not to be taken in a limiting sense, and the scope of various embodiments is defined only by the appended claims, along with the full range of equivalents to which such claims are entitled.

Although specific embodiments have been shown and described herein, it should be appreciated that any arrangement calculated to achieve the same purpose may be substituted for the specific embodiments shown. This application is intended to cover any and all adaptations or variations of various embodiments. Combinations of the above embodiments and other embodiments not specifically described herein, will be apparent to those of skill in the art upon reviewing the above description.

The Abstract is provided to comply with 37 C.F.R. §1.72(b) and will allow the reader to quickly ascertain the nature of the technical disclosure of this application. It is submitted with the understanding that it will not be used to interpret or limit the scope or meaning of the claims.

In the foregoing detailed description, various features may be grouped together in a single embodiment for the purpose of streamlining the disclosure of this application. This method of disclosure is not to be interpreted as reflecting that the claimed embodiments have more features than are expressly recited in each claim. Rather, as the following claims reflect, inventive subject matter lies in less than all features of a single disclosed embodiment.

Moreover, it is contemplated that the features or components of various embodiments described herein can be combined into different combinations that are not explicitly enumerated in the foregoing detailed description and that such combinations can similarly stand on their own as separate example embodiments that can be claimed.

The invention claimed is:

1. An anti-wrinkle pillow, the pillow comprising:

a pillow casing having a bottom sheet and a top sheet, the pillow casing filled with a fiberfill material, the pillow casing having a first and a second peripheral edges formed by the bottom sheet being secured to the top sheet, the top sheet tapering to the bottom sheet at the first and the second peripheral edges;

a first recess formed by securing the bottom sheet to the top sheet, the first recess disposed at a first location of the pillow casing;

a second recess formed by securing the bottom sheet to the top sheet, the second recess disposed at a second location of the pillow casing, the second location being a predetermined distance from the first location; and wherein the first recess and the second recess define a first and a second raised portions delineated by a trough portion extending along the predetermined distance, the first of the raised portions having an arcuate shape that extends from the trough portion and tapers to the first of the peripheral edges to form a first abutment portion at the first of the peripheral edges, the first abutment portion defined by creasing that extends from the first recess and the second recess toward the first of the peripheral edges to form indentations along the first of the peripheral edges connected by a curvilinear portion, the first and the second raised portions configured to contact a first and a second portions of a user's face, the trough portion and the second recess configured to remain contactless with one or more portions of the user's face to mitigate wrinkling of the one or more portions of the user's face along the predetermined distance, the abutment portion configured to abut the user's shoulder.

2. The pillow of claim 1, further comprising a third recess formed at a third location and a fourth recess formed at a fourth location, wherein the third location is at a second predetermined distance from the fourth location, the third recess and the fourth recess define a third raised portion delineated by a second trough portion extending along the second predetermined distance, the second and the third raised portions configured to contact the first and the second portions of a user's face, the second trough portion and the fourth recess configured to remain contactless with one or more portions of the user's face to mitigate wrinkling of the one or more portions of the user's face along the second predetermined distance.

3. The pillow of claim 2, wherein the third raised portion extends from the second trough portion to the second of the peripheral edges and defines a second abutment portion at the second of the peripheral edges of the pillow casing, the second abutment portion configured to abut the user's shoulder.

4. The pillow of claim 2, wherein the second predetermined distance is from about five to about six inches.

5. The pillow of claim 2, wherein the second predetermined distance is the same as the predetermined distance.

6. The pillow of claim 2, wherein the second predetermined distance is different from the predetermined distance.

7. The pillow of claim 1, wherein the second of the raised portions extends from the trough portion to the second of the peripheral edges and defines a second abutment portion at the second of the peripheral edges of the pillow casing, the second abutment portion configured to abut the user's shoulder.

8. The pillow of claim 1, wherein the predetermined distance is from about five to about six inches.

9. The pillow of claim 1, wherein the first recess and the second recess define an approximately linear shape at about a center of the pillow casing.

10. A method of manufacturing an anti-wrinkle pillow, the method comprising:

providing a pillow including a pillow casing and fiberfill material, the pillow casing having a bottom sheet and a top sheet, the pillow casing filled with the fiberfill material, the pillow casing having a first and a second peripheral edges formed by the bottom sheet being secured to the top sheet, the top sheet tapering to the bottom sheet at the first and the second peripheral edges;

securing the bottom sheet to the top sheet at a first location of the pillow casing to form a first recess, securing the bottom sheet to the top sheet at a second location of the pillow casing to form a second recess, the second location being a predetermined distance from the first location; and wherein the first recess and the second recess define a first and a second raised portions delineated by a trough portion extending along the predetermined distance, the first of the raised portions having an arcuate shape that extends from the trough portion and tapers to the first of the peripheral edges to form a first abutment portion at the first of the peripheral edges, the first abutment portion defined by creasing that extends from the first recess and the second recess toward the first of the peripheral edges to form indentations along the first of the peripheral edges connected by a curvilinear portion, the first and the second raised portions configured to contact a first and a second portions of a user's face, the trough portion and the second recess configured to remain contactless with one or more portions of the user's face to mitigate wrinkling of the one or more portions of the user's face along the predetermined distance, the abutment portion configured to abut the user's shoulder.

11. The method of claim 10, further comprising:

forming a third recess at a third location; and forming a fourth recess at a fourth location, wherein the third location is at a second predetermined distance from the fourth location;

wherein the third recess and the fourth recess define a third raised portion delineated by a second trough portion extending along the second predetermined distance, the second and the third raised portions configured to contact the first and the second portions of a user's face, the second trough portion and the fourth recess configured to remain contactless with one or more portions of the user's face to mitigate wrinkling of the one or more portions of the user's face along the second predetermined distance.

12. The method of claim 11, wherein the third raised portion extends from the second trough portion to the second of the peripheral edges and defines a second abutment portion at the second of the peripheral edges of the pillow casing, the second abutment portion configured to abut the user's shoulder.

13. The method of claim 11, wherein the second predetermined distance is from about five to about six inches.

14. The method of claim 11, wherein the second predetermined distance is the same as the predetermined distance.

15. The method of claim 11, wherein the second predetermined distance is different from the predetermined distance.

16. The method of claim 10, wherein the second of the raised portions extends from the trough portion to the second of the peripheral edges and defines a second abutment portion at the second of the peripheral edges of the pillow casing, the second abutment portion configured to abut the user's shoulder.

17. The method of claim 10, wherein the predetermined distance is from about five to about six inches.

18. The method of claim 10, wherein the first recess and the second recess define an approximately linear shape at about a center of the pillow casing.

* * * * *